US008727397B1

(12) United States Patent
McDonald

(10) Patent No.: US 8,727,397 B1
(45) Date of Patent: May 20, 2014

(54) VEHICLE OCCUPANT REMINDER SYSTEMS

(76) Inventor: Scott D. McDonald, Phoenix, AZ (US)

( * ) Notice: Subject to any disclaimer, the term of this patent is extended or adjusted under 35 U.S.C. 154(b) by 872 days.

(21) Appl. No.: 12/797,551

(22) Filed: Jun. 9, 2010

Related U.S. Application Data

(60) Provisional application No. 61/224,744, filed on Jul. 10, 2009.

(51) Int. Cl.
*E05C 1/02* (2006.01)

(52) U.S. Cl.
USPC ..... 292/196; 292/251.5; 292/1; 292/DIG. 15; 49/460

(58) Field of Classification Search
USPC ..... 292/196, 251.5, DIG. 19, 1, DIG. 15, 292/DIG. 2, 340, 341.14, 341.17, 304, 262; 49/460, 462, 502, 503, 394
See application file for complete search history.

(56) References Cited

U.S. PATENT DOCUMENTS

| | | | | |
|---|---|---|---|---|
| 3,676,895 | A * | 7/1972 | Stewart | 16/412 |
| 3,800,360 | A * | 4/1974 | Knarreborg | 16/83 |
| 4,261,140 | A * | 4/1981 | McLean | 49/383 |
| 5,438,312 | A | 8/1995 | Lewis | |
| 5,979,949 | A | 11/1999 | Finkelstein et al. | |
| 6,082,790 | A * | 7/2000 | Mossotti et al. | 292/341.14 |
| 6,104,293 | A | 8/2000 | Rossi | |
| 6,244,636 | B1 * | 6/2001 | Rissone | 292/202 |
| 6,588,811 | B1 | 7/2003 | Ferguson | |
| 6,874,198 | B2 * | 4/2005 | Renaud | 16/83 |
| 6,962,374 | B2 | 11/2005 | Belloma et al. | |
| 7,170,401 | B1 | 1/2007 | Cole | |
| 7,331,617 | B2 * | 2/2008 | Johnson | 292/202 |
| 7,937,806 | B1 * | 5/2011 | Doyle | 16/82 |
| 8,276,240 | B2 * | 10/2012 | Ritachka | 16/83 |
| 8,458,857 | B1 * | 6/2013 | Davis et al. | 16/82 |
| 2002/0157319 | A1 * | 10/2002 | Haq | 49/383 |
| 2007/0252407 | A1 | 11/2007 | Cavallucci et al. | |

* cited by examiner

*Primary Examiner* — Mark Williams
(74) *Attorney, Agent, or Firm* — Stoneman Law Patent Group; Martin L. Stoneman; David A. Spellman

(57) ABSTRACT

An occupant reminder system to remind at least one occupant of a vehicle, prior to leaving such vehicle, that there is at least one other occupant in the vehicle (such as a child or pet). Upon initial setting and occupancy of a vehicle, the reminder system temporarily prevents the door of the responsible occupant from latching shut to assist reminding the responsible occupant of such at least one other occupant.

20 Claims, 9 Drawing Sheets

VEHICLE OCCUPANT REMINDER SYSTEMS

CROSS-REFERENCE TO RELATED APPLICATION

The present application is related to and claims priority from prior provisional application Ser. No. 61/224,744, filed Jul. 10, 2009, entitled "VEHICLE OCCUPANT REMINDER SYSTEMS", the contents of all of which are incorporated herein by this reference and are not admitted to be prior art with respect to the present invention by the mention in this cross-reference section.

BACKGROUND

This invention relates to providing an occupant reminder system to remind at least one occupant of a vehicle, prior to leaving such vehicle, that there is at least one other occupant in the vehicle (such as a child or pet). More particularly, this invention relates to providing a system relating to reminding a driver not to leave a child in the vehicle.

OBJECTS AND FEATURES OF THE INVENTION

A primary object and feature of the present invention is to provide a system overcoming the above-mentioned problem (s).

It is a further object and feature of the present invention to provide such a system that assists reminding a driver, prior to leaving or exiting a vehicle, that there is a child in the vehicle.

It is a further object and feature of the present invention to provide such a system that once set, simply and inexpensively physically blocks a vehicle door from latching, thereby acting as a reminder to the driver or other responsible adult of an occupant still within the vehicle.

A further primary object and feature of the present invention is to provide such a system that is efficient, inexpensive, and handy. Other objects and features of this invention will become apparent with reference to the following descriptions.

SUMMARY OF THE INVENTION

In accordance with a preferred embodiment hereof, this invention provides a reminder system, relating to assisting reminding at least one first occupant of at least one vehicle, having at least one first occupant entry/exit latching door, of at least one second occupant within the at least one vehicle, comprising: blocker means for blocking latching of the at least one first occupant entry/exit latching door; user-positioner means for purposeful user-positioning of such blocker means to allow entry of the at least one first occupant into the at least one first occupant entry/exit latching door and to allow a single closing and latching of the at least one first occupant entry/exit latching door; and automatic-positioner means for automatic positioning of such blocker means, when the at least one first occupant entry/exit latching door is opened to allow exit of the at least one first occupant, to prevent the first occupant entry latching door from latching closed; wherein such reminder system assists the at least one first occupant to be reminded of the at least one second occupant. Moreover, it provides such a reminder system wherein such blocker means comprises attacher means for attaching such blocker means adjacent at least one latching component of the at least one first occupant entry/exit latching door. Additionally, it provides such a reminder system wherein such attacher means comprises magnet means for magnetically attaching such blocker means adjacent at least one latching component of the at least one first occupant entry/exit latching door. Also, it provides such a reminder system wherein such automatic-positioner means comprises gravity-enabled-positioning means for gravity-enabled-positioning of such blocker means.

In accordance with another preferred embodiment hereof, this invention provides a reminder system, relating to assisting reminding at least one first occupant of at least one vehicle, having at least one first occupant entry/exit latching door, of at least one second occupant within the at least one vehicle, comprising: at least one blocker structured and arranged to block latching of the at least one first occupant entry/exit latching door; at least one user-positioner structured and arranged to purposefully user-position such at least one blocker to allow entry of the at least one first occupant into the at least one first occupant entry/exit latching door and to allow a single closing and latching of the at least one first occupant entry/exit latching door; and at least one automatic-positioner structured and arranged to automatically position such at least one blocker, when the at least one first occupant entry/exit latching door is opened to allow exit of the at least one first occupant, to prevent the first occupant entry latching door from latching closed; wherein such reminder system assists the at least one first occupant to be reminded of the at least one second occupant.

In addition, it provides such a reminder system wherein such at least one blocker comprises at least one attacher structured and arranged to attach such at least one blocker adjacent at least one latching component of the at least one first occupant entry/exit latching door. And, it provides such a reminder system wherein such at least one attacher comprises at least one magnet structured and arranged to magnetically attaching such at least one blocker adjacent at least one latching component of the at least one first occupant entry/exit latching door. Further, it provides such a reminder system wherein such at least one automatic-positioner comprises at least one gravity-enabled-positioner structured and arranged to gravity-enable-positioning of such at least one blocker. Even further, it provides such a reminder system wherein such at least one automatic-positioner comprises at least one living hinge structured and arranged to assist such at least one gravity-enabled-positioner.

Moreover, it provides such a reminder system wherein such at least one living hinge is integral to such at least one blocker. Additionally, it provides such a reminder system wherein such at least one blocker is essentially comprised of rubber material. Also, it provides such a reminder system wherein such at least one blocker is essentially comprised of neoprene rubber. In addition, it provides such a reminder system wherein such at least one attacher comprises at least one magnetic layer structured and arranged to attach to a ferrous material. And, it provides such a reminder system wherein: such at least one user-positioner comprises at least one handle structured and arranged to be grasped by at least the at least one first occupant; and such at least one handle assists moving such at least one blocker to such user-position. Further, it provides such a reminder system wherein such at least one blocker, such at least one user-positioner, such at least one automatic-positioner, and such at least one attacher comprise rubber.

In accordance with another preferred embodiment hereof, this invention provides a reminder system, relating to assisting reminding at least one first occupant of at least one vehicle, having at least one first occupant entry/exit latching door, of at least one second occupant within the at least one vehicle, comprising: at least one blocker structured and arranged to block latching of the at least one first occupant entry/exit latching door; at least one user-positioner structured and arranged to purposefully user-position such at least one blocker to allow entry of the at least one first occupant into the at least one first occupant entry/exit latching door and to allow a single closing and latching of the at least one first occupant entry/exit latching door; and at least one automatic-positioner structured and arranged to automatically position such at least one blocker, when the at least one first occupant entry/exit latching door is opened to allow exit of the at least one first occupant, to prevent the first occupant entry latching door from latching closed; wherein such at least one blocker comprises at least one attacher structured and arranged to attach such at least one blocker adjacent at least one latching component of the at least one first occupant entry/exit latching door; wherein such at least one attacher comprises at least one magnet structured and arranged to magnetically attaching such at least one blocker adjacent at least one latching component of the at least one first occupant entry/exit latching door; wherein such at least one automatic-positioner comprises at least one gravity-enabled-positioner structured and arranged to gravity-enable-positioning of such at least one blocker; wherein such at least one automatic-positioner comprises at least one living hinge structured and arranged to assist such at least one gravity-enabled-positioner; wherein such at least one living hinge is integral to such at least one blocker; wherein such at least one blocker is essentially comprised of rubber material; wherein such at least one user-positioner comprises at least one handle structured and arranged to be grasped by at least the at least one first occupant; wherein such at least one handle assists moving such at least one blocker to such user-position; and wherein such reminder system assists the at least one first occupant to be reminded of the at least one second occupant.

Even further, it provides such a reminder system wherein such at least one attacher comprises at least one magnetic layer structured and arranged to attach to a ferrous material. Even further, it provides such a reminder system wherein such at least one blocker, such at least one user-positioner, such at least one automatic-positioner, and such at least one attacher comprise rubber. Even further, it provides such a reminder system further comprising at least one vehicle. Even further, it provides such a reminder system wherein such at least one vehicle comprises at least one child safety seat.

In accordance with another preferred embodiment hereof, this invention provides a method of reminding at least one first occupant exiting at least one vehicle, having at least one entry/exit latching door, of at least one second occupant within the at least one vehicle using at least one latch blocker in position between the "latch" and the "catch" of the at least one entry/exit latching door, the at least one latch blocker having at least two settable positions, at least one first position which permits closing of the at least one entry/exit latching door and at least one second position which blocks latching of the at least one entry/exit latching door, such method comprising the steps of: user-setting, upon entry into the at least one vehicle, the at least one latch blocker into the at least one first position allowing closing and latching of the at least one occupant entry/exit latching door; user assisting, upon opening of the at least one occupant entry/exit latching door, positioning of the at least one latch blocker into the at least one second position preventing latching of the at least one occupant entry/exit latching door; wherein the at least one first occupant may be reminded of the at least one second occupant before the at least one first occupant may latch the at least one occupant entry/exit latching door. Each and every novel feature, element, combination, step and/or method disclosed or suggested by this provisional patent application.

DETAILED DESCRIPTION OF THE BEST MODES AND PREFERRED EMBODIMENTS OF THE INVENTION

Figure 1:
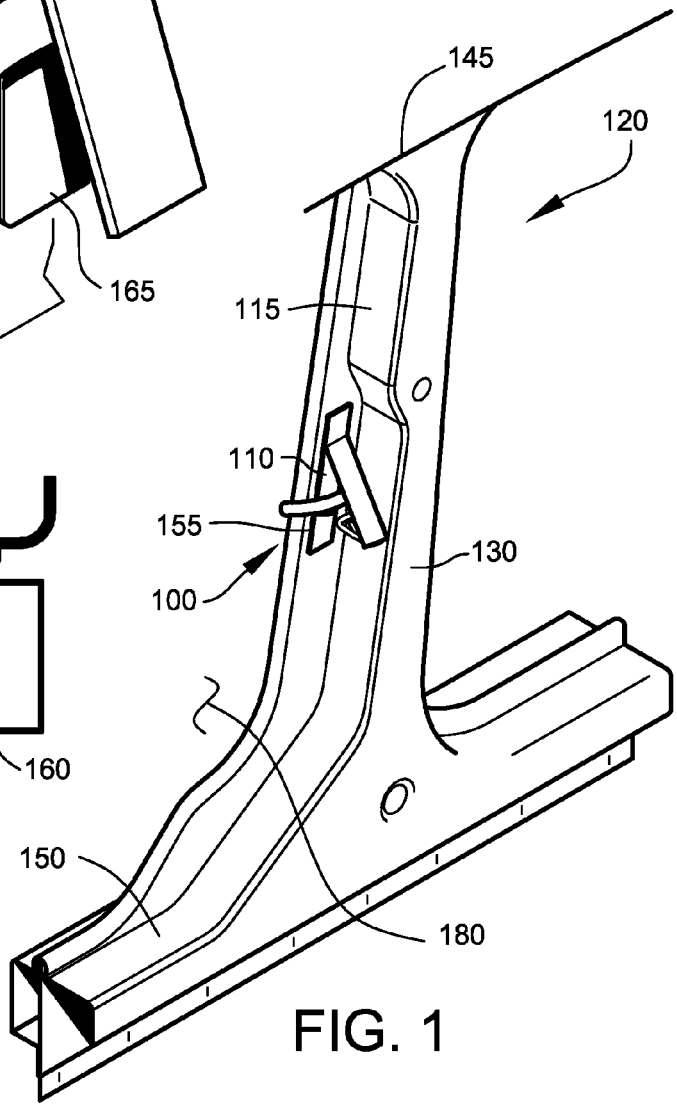
FIG. 1 shows a perspective view, illustrating a door-latch blocker of the vehicle reminder system in use on a door frame of a vehicle, according to a preferred embodiment of the present invention.

FIG. 1 shows a perspective view, illustrating a door-latch blocker 110 of the vehicle reminder system 100 in use on a door frame 115 of a vehicle 120, according to a preferred embodiment of the present invention. The vehicle reminder system 100 preferably comprises a door-latch blocker 110 that, when operable, prevents the door 125 (see FIG. 5) on which the door-latch blocker 110 is attached from being latch closed; thereby assisting the driver, or other responsible first occupant, to be reminded that there is at least one second occupant in the vehicle 120. Upon reading this specification, those with ordinary skill in the art will now appreciate that, under appropriate circumstances, considering such issues as user preferences, marketing preferences, cost, technological advances, etc., a reminder for other than an occupant such as, for example, a reminder for an object, such as, foods, make-up, candles, gifts, medicines, etc., may suffice.

Preferably, the door-latch blocker 110 is installed on the drivers-side door, preferably along the vertical B-Pillar 130, preferably located above the striker pin 135, as shown. Upon reading this specification, those with ordinary skill in the art will now appreciate that, under appropriate circumstances, considering such issues as design preference, user preferences, technological advances, etc., other placement arrangements such as, for example, placement on the C-pillar, D-pillar, other latch locations, etc., may suffice.

Figure 11:
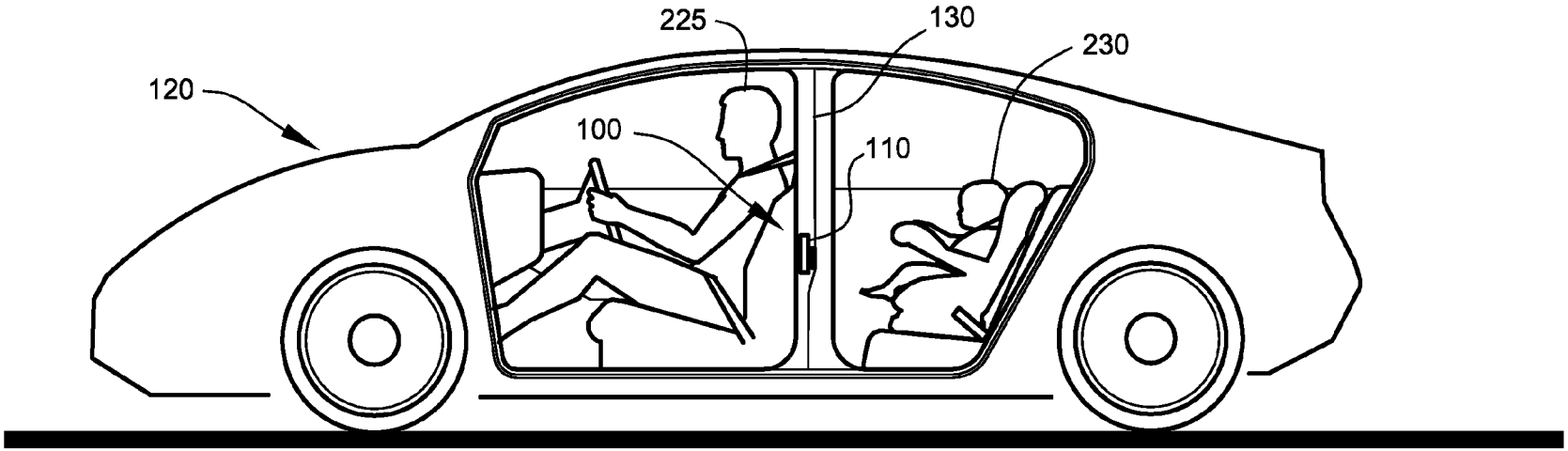
FIG. 11 shows a side view of a vehicle (with doors not shown) illustrating the vehicle occupant reminder system, according to the preferred embodiment of FIG. 1.

Conventional doors of most vehicles in use today have a hinged portion on the front-facing (towards the front of the vehicle) side of the door 125 that allows the door 125 to swing outwardly from the body of the vehicle 120. The door 125 preferably comprises a lock mechanism 140 (see FIG. 5) that clasps onto at least one striker pin 135 (shown as a U-shaped striker pin often used for added safety to transfer loads better and reduce potential injury by a straight protruding striker pin, for example) often placed about the center of the door jamb B-pillar 130 between the top 145 of the door jamb B-pillar 130 and the bottom 150 of the door frame 115, as shown (B-pillar generally known in the art as representing the support post or pillar typically on each side of the vehicle behind the windshield frame support, or A-pillar, and forming part of the door opening framing for the front doors, as shown in FIG. 11).

Preventing the clasping of the lock mechanism 140 onto the striker pin 135 will preferably prevent the door from latching closed. The door latching prevention preferably is the reminder to the responsible occupying party of the vehicle to check for other occupants (such as, for example, a sleeping child).

Figure 2:
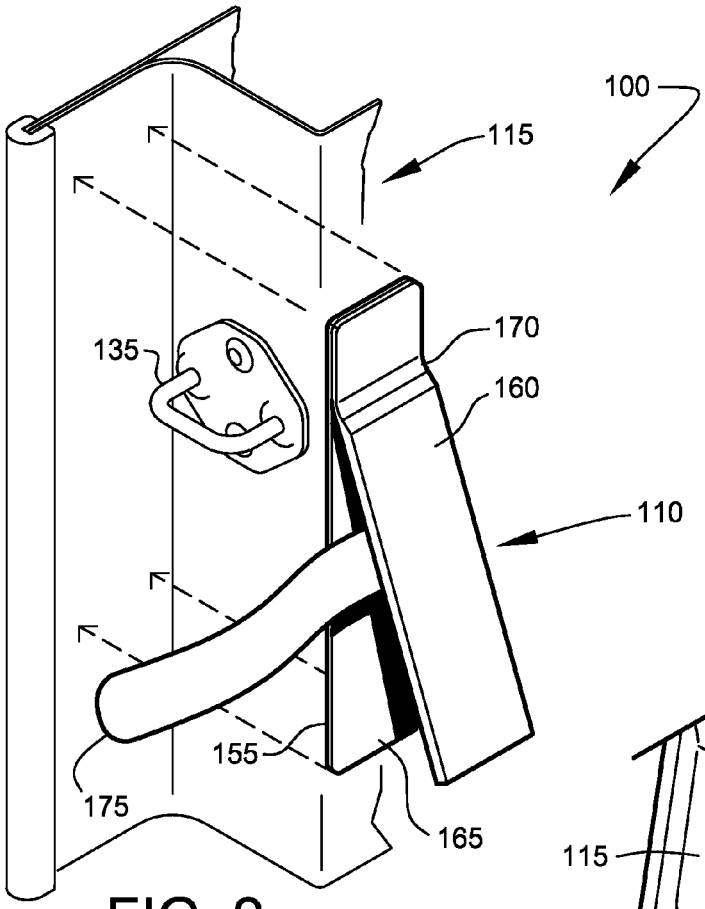
FIG. 2 shows a perspective view, illustrating a door-latch blocker placement on a door frame, according to the preferred embodiment of FIG. 1.
Figure 3:
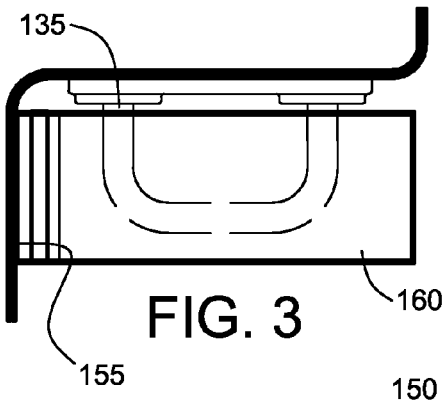
FIG. 3 shows a top view, illustrating a blocking position of the door-latch blocker, according to the preferred embodiment of FIG. 1.

FIG. 2 shows a perspective view, illustrating door-latch blocker 110 placement on a door frame 115, according to the preferred embodiment of FIG. 1. FIG. 3 shows a top view, illustrating a blocking position of the door-latch blocker, according to the preferred embodiment of FIG. 1.

The door-latch blocker 110 preferably comprises a blocker tab 160, an attacher tab 165, a hinge portion 170 and a set tab 175, as shown. The door-latch blocker 110 is preferably positioned above and behind the striker pin 135 so that the blocker tab 160 will cover the striker pin 135, when the blocker tab 160 activates, as further described below and as shown. The attacher tab 165 preferably attaches to the door frame 115. For use on vehicles with a metal door frame (preferably comprising at least one ferrous material), the attacher tab 165 preferably comprises a magnetic strip 155, preferably about five inches to about seven inches in length (preferably, attacher tab 165 is entirely magnetic). For use on vehicle having a door frame that is other than metallic (i.e., non-ferrous materials), attacher tab 165 preferably comprises an adhesive to assist attaching to the door frame, preferably removable adhesive. Those with ordinary skill in the art will now appreciate that upon reading this specification and by their understanding the art of attachment as described herein, other methods of attachment of the attacher tab 165 to the door frame 115 will be understood by those knowledgeable in such art.

Blocker tab 160 preferably comprises a hard rubber, preferably about five inches to about seven inches in length (preferably about the same length as the attacher tab 165, as shown) and about one inch to about one and one-half inches wide, preferably 3/16 neoprene rubber, preferably having an ASTM D2240 type A (Shore A) hardness of between about 65 and about 90, preferably 85 (as commercially available from plastic providers such as Central Plastics Company of Shawnee, Okla. [http://www.centralplastics.com]).

Figure 4:
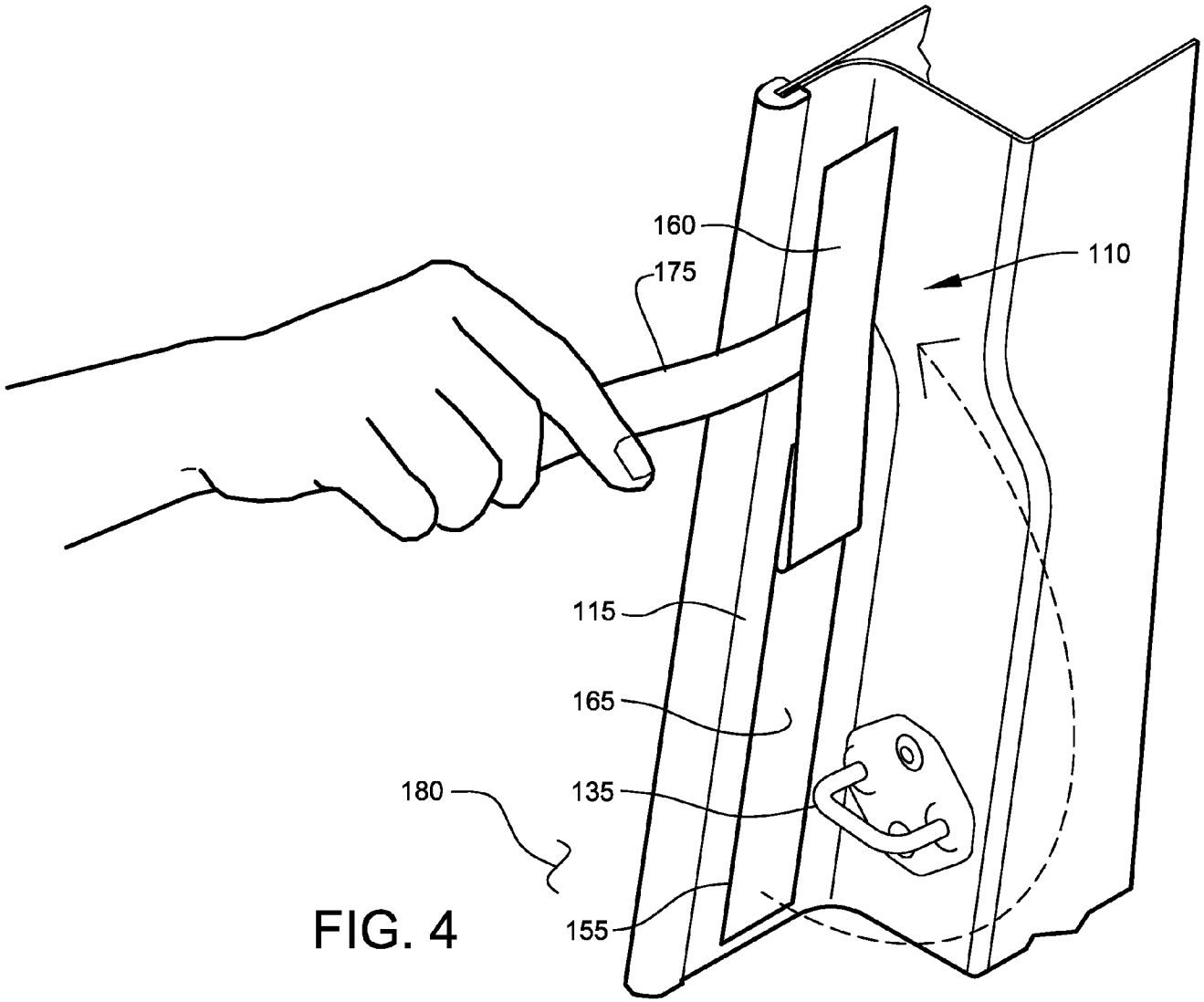
FIG. 4 shows a perspective view, illustrating setting of a ready position of the door-latch blocker, according to the preferred embodiment of FIG. 1.

FIG. 4 shows a perspective view, illustrating setting of a ready position 200 of the door-latch blocker 110, according to the preferred embodiment of FIG. 1. Preferably, hinge portion 170 is attached to both attacher tab 165 and blocker tab 160, as shown (see FIG. 8). Hinge portion 170 preferably assists blocker tab 160 to be movable in at least about 180-degree arc. Hinge portion 170 preferably comprises a "living hinge" 195 meaning essentially that the hinge is integral material that bends or flexes to allow hinge functioning (see FIG. 10). Hinge portion 170 is preferably a living hinge comprised of a thinned portion 185 of blocker tab 160, preferably rubber, preferably about one-eighth inch thick.

Set tab 175 preferably comprises a flexible rubber, preferably about 1/16 inch in thickness, preferably flat. Upon reading this specification, those with ordinary skill in the art will now appreciate that, under appropriate circumstances, considering such issues as design preference, user preferences, marketing preferences, cost, structural requirements, available materials, technological advances, etc., other "set tab" material arrangements such as, for example, durable fabric, rubber, natural materials (for example, hemp), etc., may suffice.

Preferably, set tab 175 is about six inches in length or as needed to extend from the B-pillar 130 to the opening 180 of the door 125, as shown. Preferably, set tab 175 is about one inch wide. Upon reading this specification, those with ordinary skill in the art will now appreciate that, under appropriate circumstances, considering such issues as design preference, user preferences, marketing preferences, cost, structural requirements, available materials, technological advances, etc., other dimension arrangements such as, for example, longer or smaller dimensions, strings, etc., may suffice.

Figure 5:
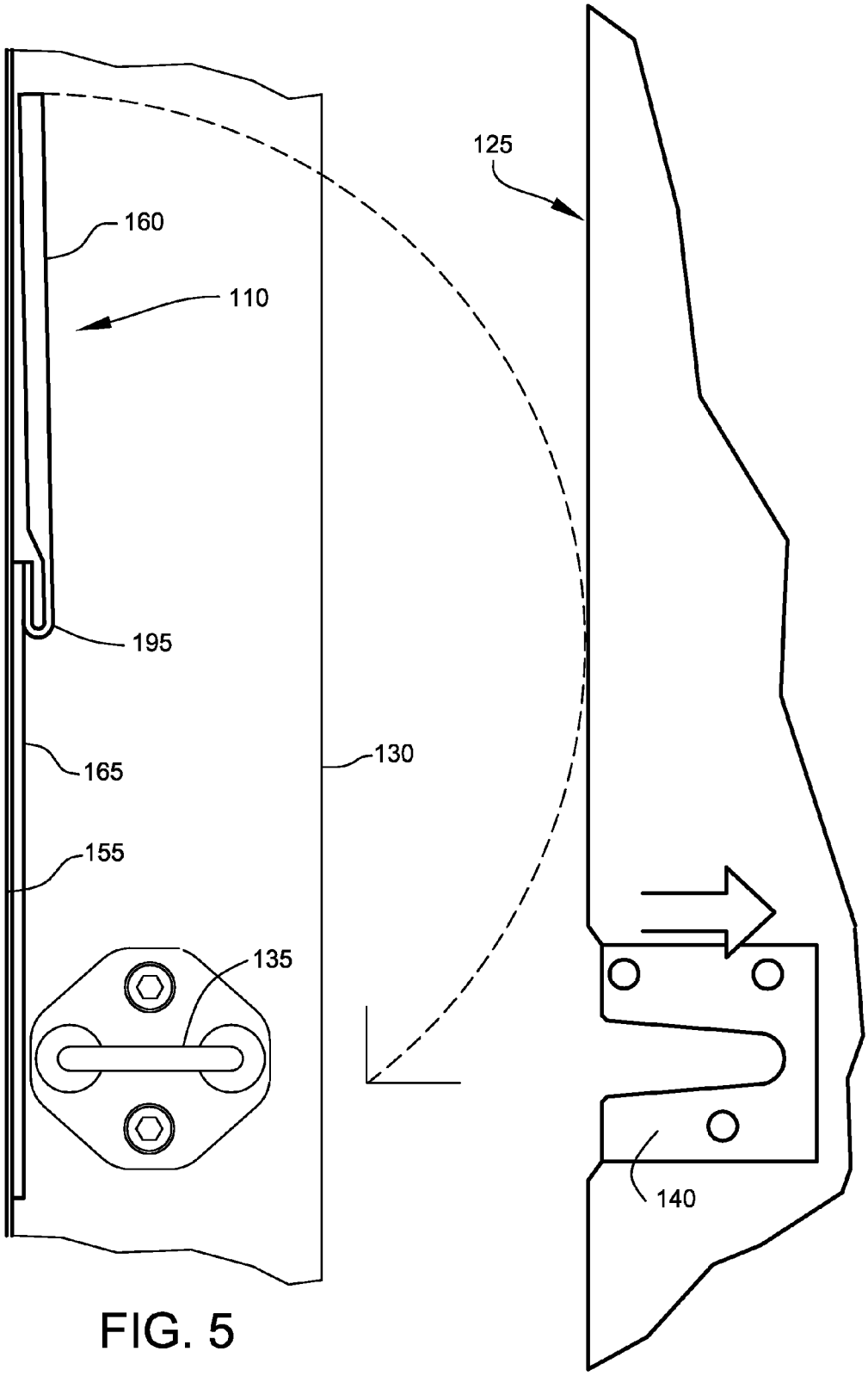
FIG. 5 shows a side view, illustrating the transition between the ready position and the blocker position of the door-latch blocker, according to the preferred embodiment of FIG. 1.
Figure 6:
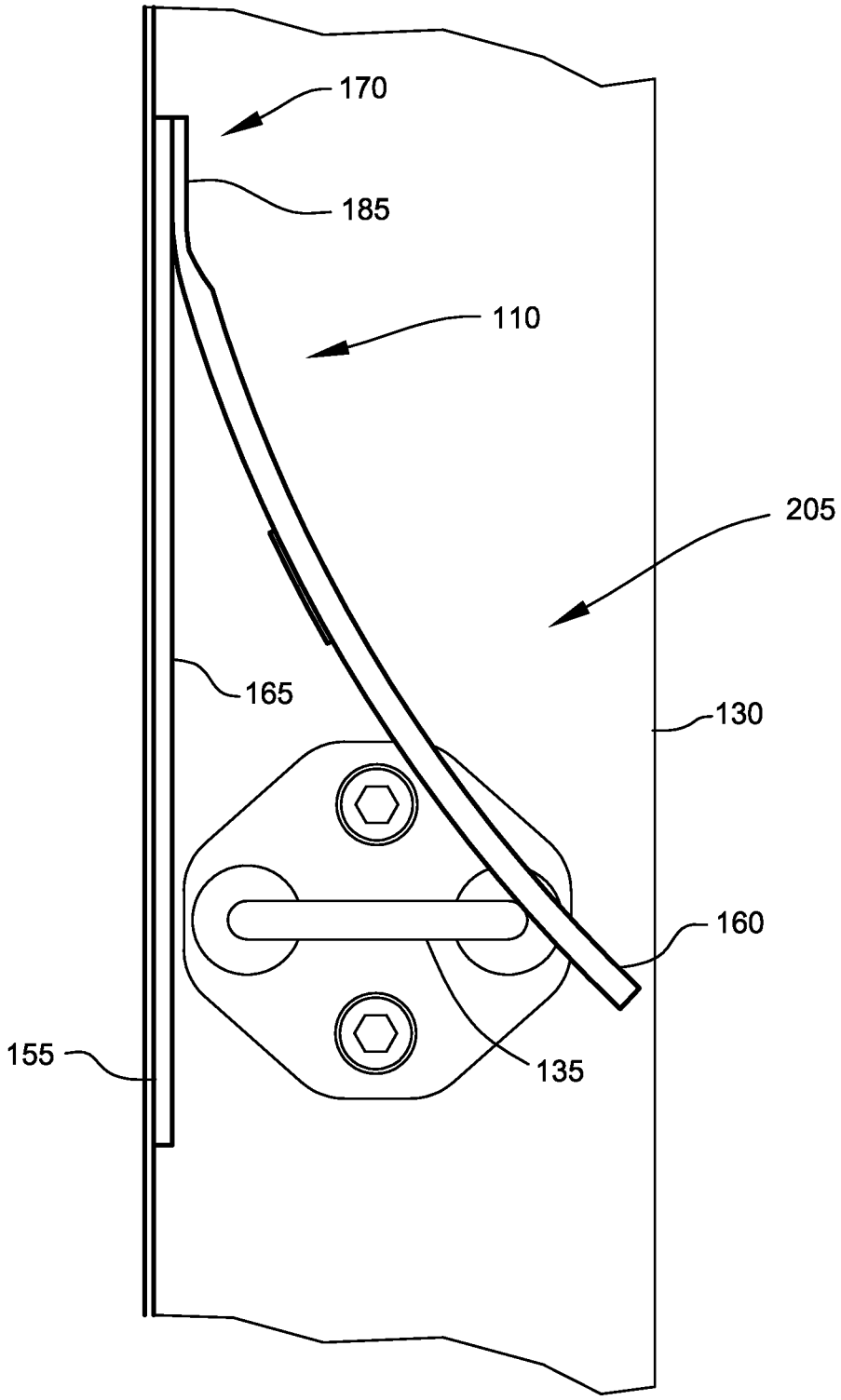
FIG. 6 shows a side view, further illustrating the blocker position of the door-latch blocker, according to the preferred embodiment of FIG. 1.
Figure 7:
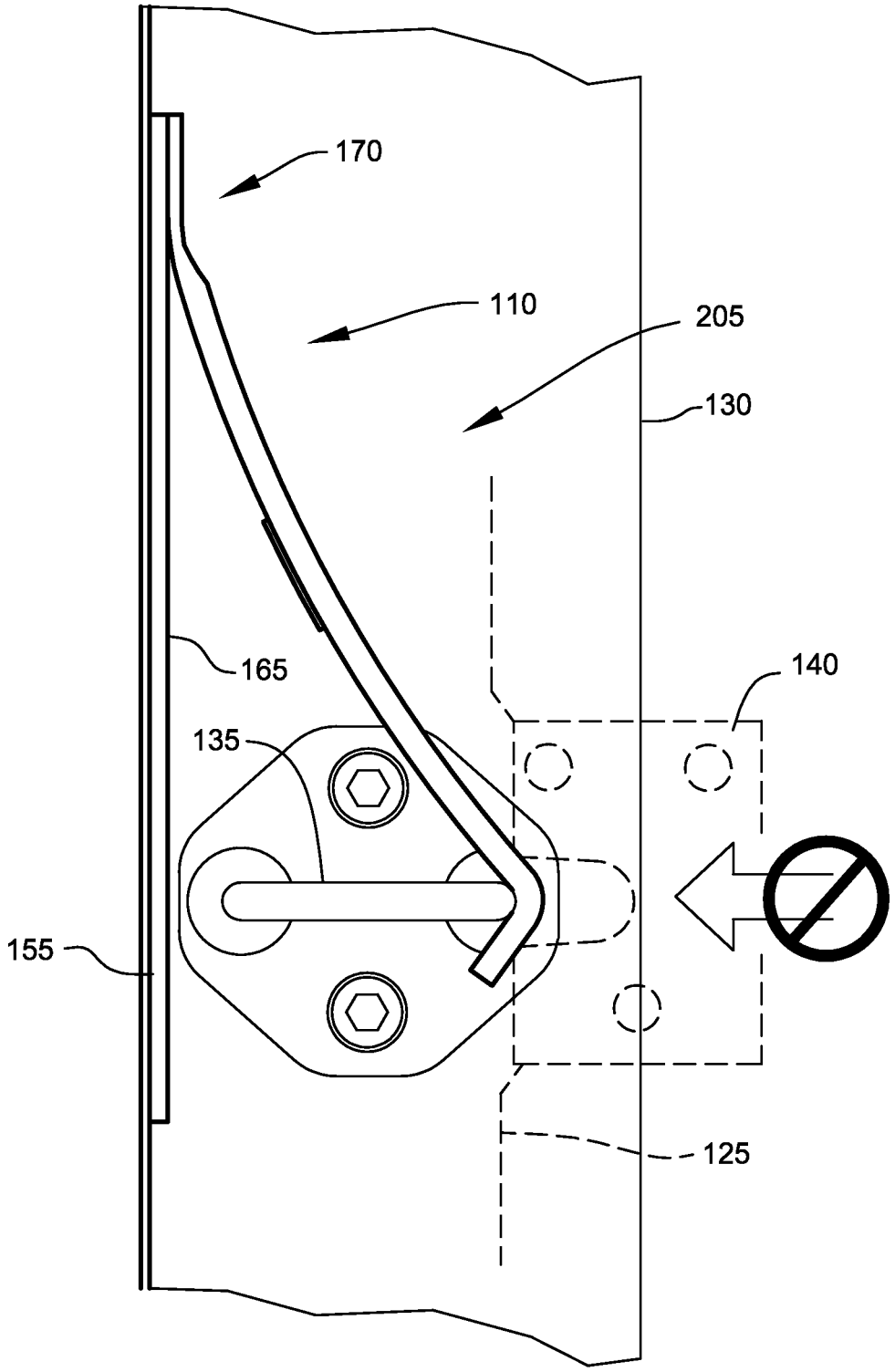
FIG. 7 shows a perspective view, illustrating the door-latch blocker blocking the lock mechanism from coupling with the striker pin, according to the preferred embodiment of FIG. 1.
Figure 9:
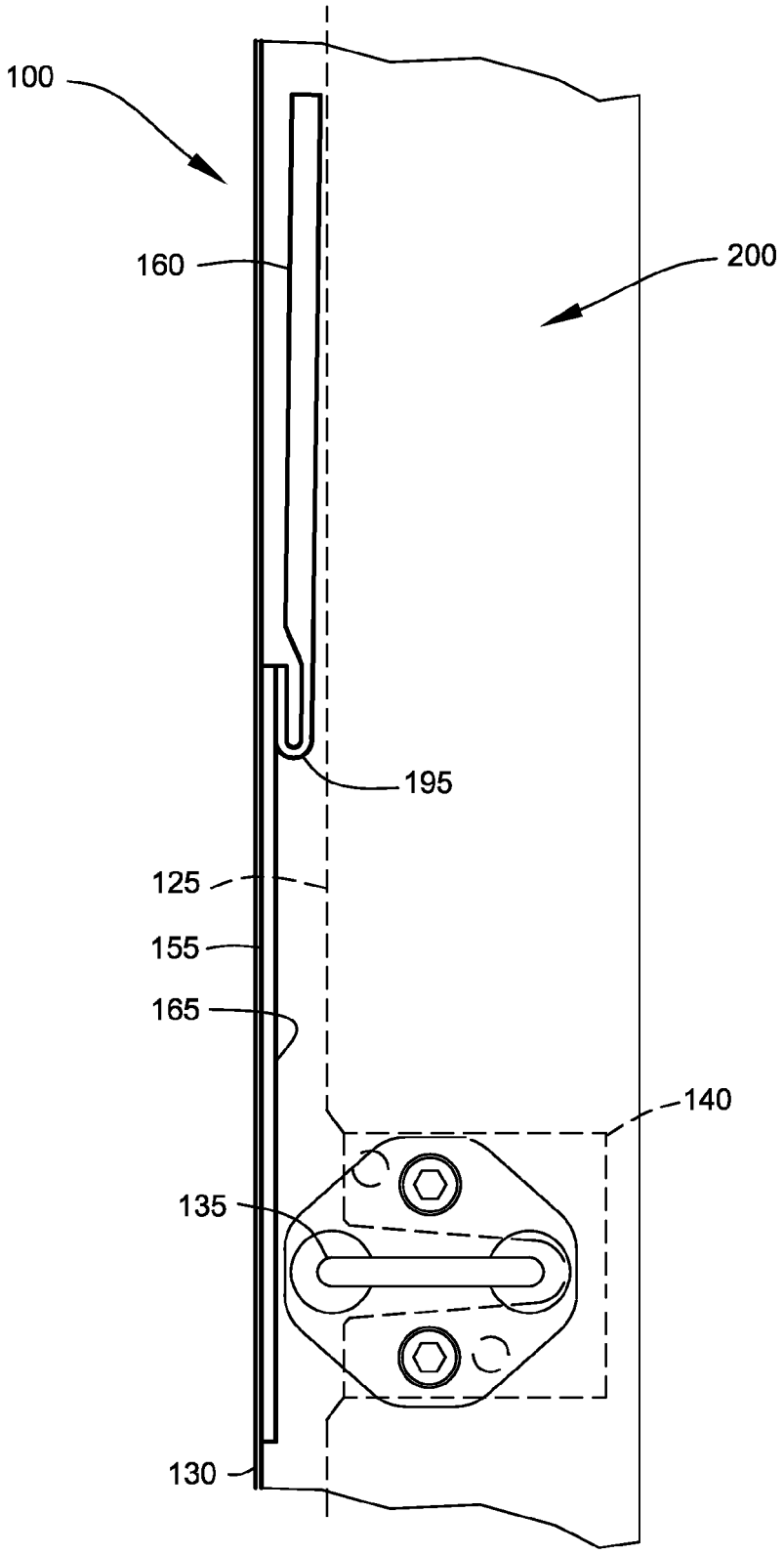
FIG. 9 shows a side view, of the door-latch blocker illustrating a preferred installation arrangement according to the preferred embodiment of FIG. 1.

FIG. 5 shows a side view illustrating the transition between the ready position 200 and the blocker position 205 of the door-latch blocker 110, according to the preferred embodiment of FIG. 1. FIG. 6 shows a side view further illustrating the blocker position 205 of the door-latch blocker 110, according to the preferred embodiment of FIG. 1. FIG. 7 shows a perspective view, illustrating the door-latch blocker 110 blocking the lock mechanism 140 from coupling with the striker pin 135, according to the preferred embodiment of FIG. 1 [at least embodying herein at least one latch blocker in position between the "latch" (lock mechanism 140) and the "catch" (striker pin 135) of the at least one entry/exit latching door]. FIG. 9 shows a side view of the door-latch blocker 110 illustrating a preferred installation arrangement according to the preferred embodiment of FIG. 1.

Preferably the door-latch blocker is best utilized by the driver of a vehicle. In a preferred method of use, the door-latch blocker 110, once installed as described above, is utilized in the following manner: First, the driver preferably opens the driver-side door and enters the vehicle. Prior to closing the vehicle door, the set tab 175 is preferably grasped by the driver and lifted so as to raise the blocker tab 160 (see FIG. 4) to a ready position 200 (at least embodying herein user-setting, upon entry into the at least one vehicle, the at least one latch blocker into the at least one first position allowing closing and latching of the at least one occupant entry/exit latching door). Next, while continuing to hold the set tab the vehicle door is preferably closed (see FIG. 10). Preferably, upon exiting the vehicle the driver preferably opens the driver-side door, preferably wide enough to exit the vehicle. The blocker tab 160 preferably falls from the raised ready position 200 to a blocker position 205, preferably falling to such blocker position 205 by gravitational pull on the blocker tab 160, as shown (see FIG. 5 and FIG. 6). When in the blocker position 205, door lock mechanism 140 is prevented from coupling with the striker pin 135, as shown (see FIG. 7). The above description at least embodies herein user assisting, upon opening of the at least one occupant entry/exit latching door, positioning of the at least one latch blocker into the at least one second position preventing latching of the at least one occupant entry/exit latching door. Preferably, the prevention of the door being able to be latched closed reminds at least the driver that there is another occupant within the vehicle. Preferably, such reminder assists in keeping a driver from leaving a child or other occupant within a locked vehicle (at least embodying herein wherein the at least one first occupant may be reminded of the at least one second occupant before the at least one first occupant may latch the at least one occupant entry/exit latching door).

Figure 8:
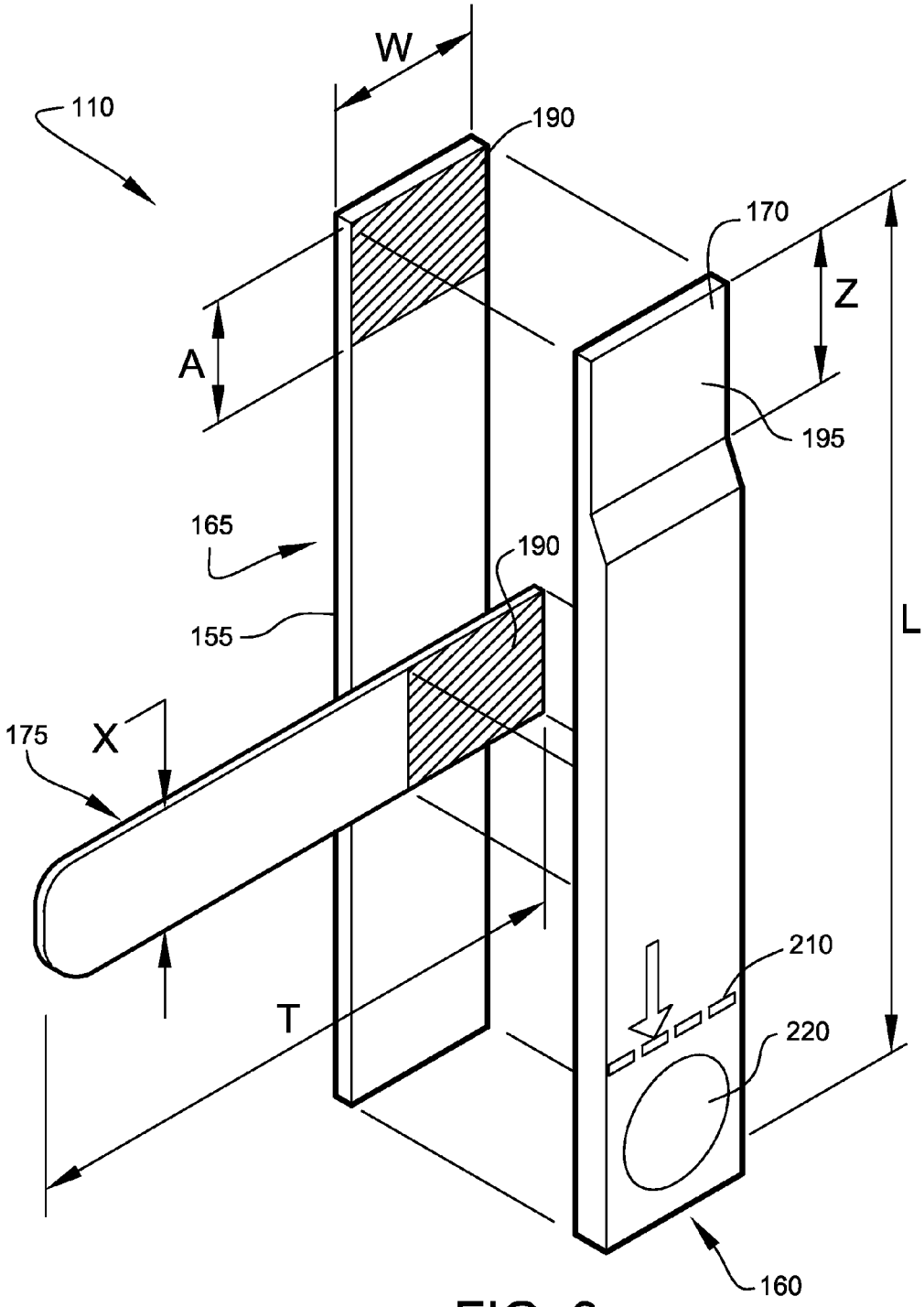
FIG. 8 shows an exploded perspective view, illustrating the door-latch blocker components, according to the preferred embodiment of FIG. 1.

FIG. 8 shows an exploded perspective view, illustrating the door-latch blocker, according to the preferred embodiment of FIG. 1. As stated above, door-latch blocker 110 preferably comprises a blocker tab 160, an attacher tab 165, a hinge portion 170 and a set tab 175, as shown.

Blocker tab 160 preferably is about five inches to about seven inches in length "L". The attacher tab 165 preferably is about five inches to about seven inches in length "L" (preferably about the same length as the attacher tab 165, as shown). Preferably, both blocker tab 160 and attacher tab 165 are about one inch to about one and one-half inches wide "W", as shown.

Set tab 175 preferably comprises a flexible rubber, preferably about 1/16 inch in thickness, preferably flat. Set tab 175 preferably is about six inches in length "T". Preferably, set tab 175 is about one inch wide "X". Living hinge preferably is about one inch to about one and one-half inches in length "Z", as shown.

Attacher tab 165 is preferably coupled to blocker tab 160, preferably at the living hinge 195, preferably using adhesive 190, preferably permanent adhesive. Further, set tab 175 is preferably coupled to blocker tab 160, preferably using adhesive 190, preferably permanent adhesive, preferably about the middle third of blocker tab 160, preferably about the half-way point of blocker tab 160, as shown. Those with ordinary skill in the art will now appreciate that upon reading this specification and by their understanding the art of attachment as described herein, methods of adhering the preferably rubber components will be understood by those knowledgeable in the art. Adhesive 190 is preferably applied at about the same width dimension "A" as the living hinge 195, preferably at least about one inch, as shown.

Blocker tab 160 preferably comprises at least one marker 210, preferably comprising a dashed line or other indicia to assist locating the preferred position of the door-latch blocker 110 on the vehicle door frame 115 so that the marker 210 is at about the level of the striker pin 135, as shown. In addition, blocker tab 160 preferably comprises at least one indicia 220, preferably comprising at least one symbolic representation relating to use of door-latch blocker 110, such as, for example, an image of a child in a car seat. Upon reading this specification, those with ordinary skill in the art will now appreciate that, under appropriate circumstances, considering such issues as design preference, user preferences, marketing preferences, cost, available indicia, technological advances, etc., other indicia arrangements such as, for example, a pet, a photograph, a light bulb (i.e., reminder), etc., may suffice.

Figure 10:
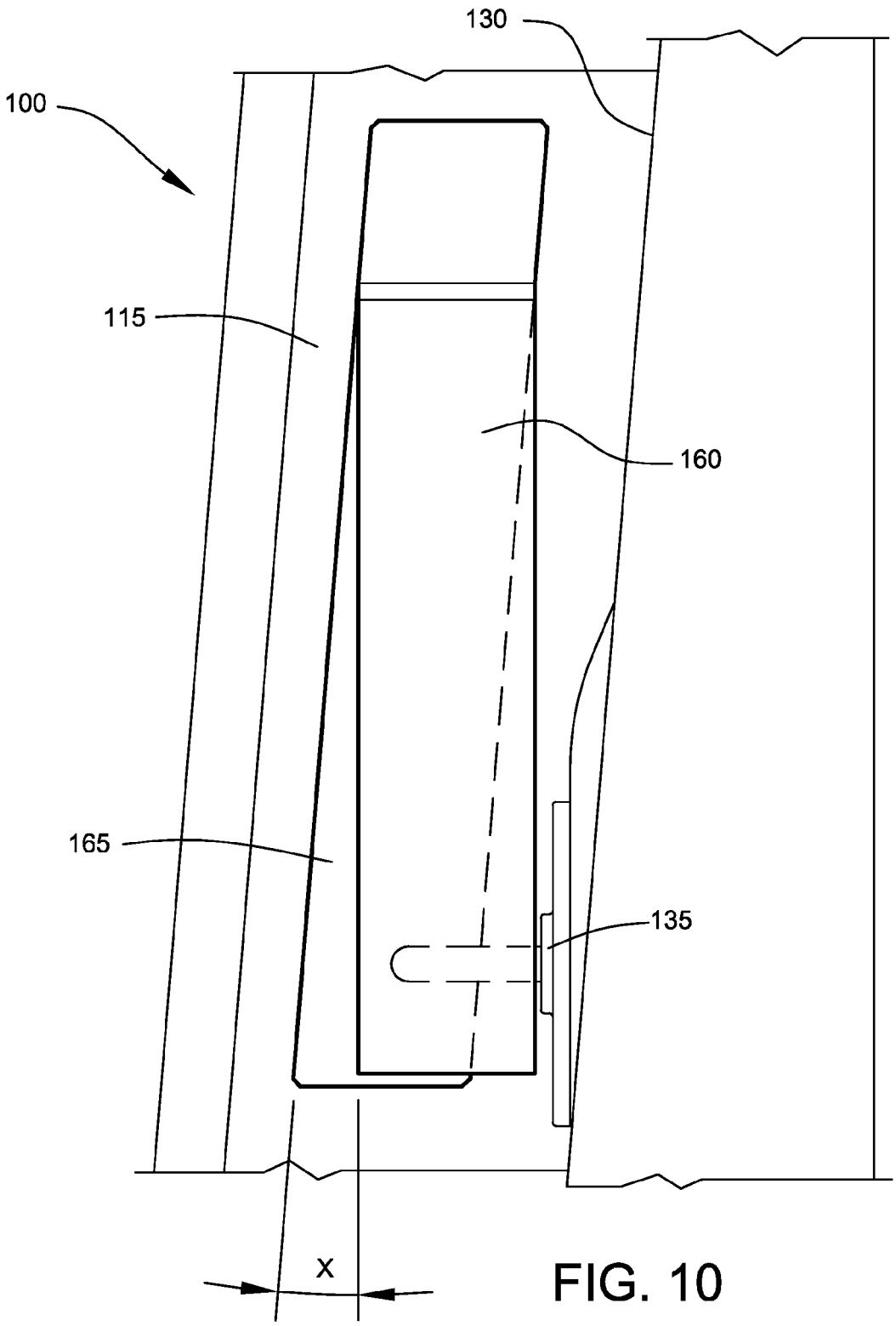
FIG. 10 shows a front view of the door-latch blocker, illustrating a preferred offset when in the blocker position, according to another preferred embodiment of the present invention.

FIG. 10 shows a front view of the door-latch blocker 110, illustrating a preferred offset when in the blocker position 205, according to another preferred embodiment of the present invention. On some vehicles with an angled B-pillar 130, it may be preferable to have a slight offset "X" between the attacher tab 165 and the blocker tab 160 to facilitate maximum area on the door frame 115 for attacher tab 165 so as to have the blocker tab 160 fall directly in front of the striker pin 135, as shown. The preferred offset "X" on such vehicles is between about 18 and 20 degrees. Upon reading this specification, those with ordinary skill in the art will now appreciate that, under appropriate circumstances, considering such issues as vehicle design preference, user preferences, vehicle structural requirements, technological advances, etc., other offset arrangements such as, for example, greater or lesser, swivel, hinged, etc., may suffice.

FIG. 11 shows a side view of a vehicle (with doors not shown) illustrating the vehicle occupant reminder system, according to the preferred embodiment of FIG. 1. As previously stated, the vehicle reminder system 100 preferably comprises a door-latch blocker 110 that, when operable, prevents the door 125 (see FIG. 5) on which the door-latch blocker 110 is attached—not to latch closed; thereby assisting the driver, or other responsible first occupant 225, to be reminded that there is at least one second occupant 230 in the vehicle 120.

Although applicant has described applicant's preferred embodiments of this invention, it will be understood that the broadest scope of this invention includes modifications such as diverse shapes, sizes, and materials. Such scope is limited only by the below claims as read in connection with the above specification. Further, many other advantages of applicant's invention will be apparent to those skilled in the art from the above descriptions and the below claims.

What is claimed is:

1. A reminder system, relating to assisting in reminding a first occupant of a vehicle of at least one second occupant of the vehicle, the vehicle having a first occupant entry/exit latching door, said reminder system comprising:

a) at least one blocker, said at least one blocker structured and arranged to block latching of the at least one first occupant entry/exit latching door, said at least one blocker adapted to prevent latching of the at least one first occupant entry/exit latching door when said at least one blocker is positioned in a blocking orientation located between an associated latch and striker, so as to prevent an engagement between the associated latch and striker;

b) at least one user-positioner, said at least one user-positioner structured and arranged to purposefully allow a user to position said at least one blocker in an unblocking orientation so as to allow entry of the at least one first occupant into the at least one first occupant entry/exit latching door and to allow a single closing and latching of the at least one first occupant entry/exit latching door; and c) at least one automatic-positioner, said at least one automatic-positioner structured and arranged to automatically position said at least one blocker from said unblocking orientation to said blocking orientation when the at least one first occupant entry/exit latching door is opened to allow exit of the at least one first occupant, so as to prevent the first occupant entry latching door from latching closed;

d) wherein such reminder system assists the at least one first occupant to be reminded of the at least one second occupant by preventing a normal latching of the entry/exit latching door.

2. The reminder system according to claim 1 wherein said at least one blocker comprises at least one attacher, said at least one attacher structured and arranged to attach said at least one blocker adjacent at least one latching component of the at least one first occupant entry/exit latching door.

3. The reminder system according to claim 2 wherein said at least one attacher comprises at least one magnet, said at least one magnet structured and arranged to magnetically attach said at least one blocker adjacent the at least one latching component of the at least one first occupant entry/exit latching door.

4. The reminder system according to claim 1 wherein said at least one automatic-positioner comprises at least one gravity-enabled-positioner, said at least one gravity-enabled-positioner structured and arranged to allow positioning by the use of gravity of said at least one blocker.

5. The reminder system according to claim 4 wherein said at least one automatic-positioner comprises at least one living hinge, said at least one living hinge structured and arranged to assist said at least one gravity-enabled-positioner.

6. The reminder system according to claim 5 wherein said at least one living hinge is integral to said at least one blocker.

7. The reminder system according to claim 1 wherein said at least one blocker is essentially comprised of rubber material.

8. The reminder system according to claim 7 wherein said at least one blocker is essentially comprised of neoprene rubber.

9. The reminder system according to claim 2 wherein said at least one attacher comprises at least one magnetic layer, said at least one magnetic layer structured and arranged to attach to a ferrous material.

10. The reminder system according to claim 1 wherein:

a) said at least one user-positioner comprises at least one handle, said at least one handle structured and arranged to be grasped by at least the at least one first occupant; and b) said at least one handle assists moving said at least one blocker to the unblocking orientation.

11. The reminder system according to claim 2 wherein said at least one blocker, said at least one user-positioner, said at least one automatic-positioner, and said at least one attacher comprise rubber.

12. A reminder system, relating to assisting in reminding at least one first occupant of at least one a vehicle of at least one second occupant of the vehicle, the vehicle having at least one first occupant entry/exit latching door, said reminder system comprising:

a) at least one blocker, said at least one blocker structured and arranged to block latching of the at least one first occupant entry/exit latching door, said at least one blocker adapted to prevent latching of said at least one first occupant entry/exit latching door when said at least one blocker is positioned in a blocking orientation located between an associated latch and striker, so as to prevent an engagement between the associated latch and striker;

b) at least one user-positioner, said at least one user-positioner structured and arranged to purposefully allow a user to position said at least one blocker in an unblocking orientation so as to allow entry of the at least one first occupant into the at least one first occupant entry/exit latching door and to allow a single closing and latching of the at least one first occupant entry/exit latching door; and c) at least one automatic-positioner, said at least one automatic positioner structured and arranged to automatically position said at least one blocker from said unblocking orientation to said blocking orientation, when the at least one first occupant entry/exit latching door is opened to allow exit of the at least one first occupant, so as to prevent the first occupant entry latching door from latching closed;

d) wherein said at least one blocker comprises at least one attacher, said at least one attacher structured and arranged to attach said at least one blocker adjacent at least one latching component of the at least one first occupant entry/exit latching door;

e) wherein said at least one attacher comprises at least one magnet, said at least one magnet structured and arranged to magnetically attaching said at least one blocker adjacent the at least one latching component of the at least one first occupant entry/exit latching door;

f) wherein said at least one automatic-positioner comprises at least one gravity-enabled-positioner, said at least one gravity-enabled-positioner structured and arranged to gravity-enable-positioning of said at least one blocker;

g) wherein said at least one automatic-positioner comprises at least one living hinge, said at least one living hinge structured and arranged to assist said at least one gravity-enabled-positioner;

h) wherein said at least one living hinge is integral to said at least one blocker;

i) wherein said at least one blocker is essentially comprised of rubber material;

j) wherein said at least one user-positioner comprises at least one handle, said at least one handle structured and arranged to be grasped by at least the at least one first occupant;

k) wherein said at least one handle assists moving said at least one blocker to such user-position; and l) wherein such reminder system assists the at least one first occupant to be reminded of the at least one second occupant by preventing a normal latching of the entry/exit latching door.

13. The reminder system according to claim 12 wherein said at least one attacher comprises at least one magnetic layer, said at least one magnetic layer structured and arranged to attach to a ferrous material.

14. The reminder system according to claim 12 wherein said at least one blocker, said at least one user-positioner, said at least one automatic-positioner, and said at least one attacher comprise rubber.

15. The reminder system according to claim 12 further comprising the vehicle.

16. The reminder system according to claim 13 wherein said vehicle comprises at least one child safety seat.

17. A method of reminding at least one first occupant exiting a vehicle of at least one second occupant within the at least one vehicle, the vehicle having at least one entry/exit latching door, using at least one latch blocker in position between the "latch" and the "catch" of the at least one entry/exit latching door, the at least one latch blocker having at least two settable positions, a first position which permits closing of the at least one entry/exit latching door and a second position which blocks latching of the at least one entry/exit latching door, said method comprising the steps of:

a) user-setting, upon entry into the vehicle, the at least one latch blocker into the first position allowing closing and latching of the at least one occupant entry/exit latching door;

b) user assisting, upon opening of the at least one occupant entry/exit latching door, positioning of the at least one latch blocker into the second position preventing latching of the at least one occupant entry/exit latching door;

c) wherein the at least one first occupant may be reminded of the at least one second occupant before the at least one first occupant may latch the at least one occupant entry/exit latching door.

18. A reminder system, relating to assisting reminding at least one first occupant of a vehicle of a second occupant of the vehicle, the vehicle having at least one first occupant entry/exit latching door, said reminder system comprising:

a) blocker means for blocking latching of the at least one first occupant entry/exit latching door, said blocker means adapted to prevent latching of the at least one first occupant entry/exit latching door when said blocker means is positioned in a blocking orientation located between an associated latch and striker, so as to prevent an engagement between the associated latch and striker;

b) user-positioner means for purposeful user-positioning of said blocker means to allow entry of the at least one first occupant into the at least one first occupant entry/exit latching door and to allow a single closing and latching of the at least one first occupant entry/exit latching door; and c) automatic-positioner means for automatic positioning of said blocker means, when the at least one first occupant entry/exit latching door is opened to allow exit of the at least one first occupant, so as to prevent the at least one first occupant entry/exit latching door from latching closed;

d) wherein such reminder system assists the at least one first occupant to be reminded of the at least one second occupant by preventing a normal latching of the at least one entry/exit latching door.

19. The reminder system according to claim 18 wherein said blocker means comprises attacher means for attaching said blocker means adjacent at least one latching component of the at least one first occupant entry/exit latching door.

20. The reminder system according to claim 18 wherein said automatic-positioner means comprises gravity-enabled-positioning means for gravity-enabled-positioning of said blocker means.

* * * * *

UNITED STATES PATENT AND TRADEMARK OFFICE

CERTIFICATE OF CORRECTION

PATENT NO. : 8,727,397 B1
APPLICATION NO. : 12/797551
DATED : May 20, 2014
INVENTOR(S) : Scott D. McDonald It is certified that error appears in the above-identified patent and that said Letters Patent is hereby corrected as shown below:

In the Claims

Column 9: Claim 12, Line 34 reads: --least one first occupant of at least one a vehicle of at least one--
-which should read: --least one first occupant of a vehicle of at least one--

Signed and Sealed this
Fifth Day of August, 2014

Michelle K. Lee

Michelle K. Lee
*Deputy Director of the United States Patent and Trademark Office*